United States Patent [19]

Berg

[11] Patent Number: 4,606,174

[45] Date of Patent: Aug. 19, 1986

[54] METHOD AND AN ARRANGEMENT FOR THE MANUFACTURE OF PACKING CONTAINERS

[75] Inventor: Rune Berg, Lausanne, Switzerland

[73] Assignee: Tetra Pak International AB, Lund, Sweden

[21] Appl. No.: 702,735

[22] Filed: Feb. 19, 1985

[30] Foreign Application Priority Data

Mar. 8, 1984 [SE] Sweden ..... 8401288

[51] Int. Cl.[4] ..... B65B 3/12; B65B 3/26

[52] U.S. Cl. ..... 53/451; 53/239; 53/474; 53/551

[58] Field of Search ..... 53/79, 239, 403, 450, 53/451, 469, 474, 550, 551, 552, 553, 554, 574, 575

[56] References Cited

U.S. PATENT DOCUMENTS

| | | | |
|---|---|---|---|
| 2,027,342 | 1/1936 | Hopkins | 53/451 X |
| 2,160,367 | 5/1939 | Maxfield | 53/451 X |
| 2,341,340 | 2/1944 | Sternfield et al. | 53/474 |
| 2,962,843 | 12/1960 | Hoelzer et al. | 53/451 X |
| 3,269,079 | 8/1966 | Schmied | 53/551 X |
| 3,470,672 | 10/1969 | Tuma | 53/551 X |
| 3,777,447 | 12/1973 | Herbine et al. | 53/474 X |
| 4,372,100 | 2/1983 | Miller et al. | 53/474 X |

*Primary Examiner*—E. R. Kazenske
*Assistant Examiner*—Michael D. Folkerts
*Attorney, Agent, or Firm*—Burns, Doane, Swecker & Mathis

[57] ABSTRACT

In the manufacture of packing containers of the type containing a liquid product with a certain portion of "solid" particles (e.g. soup with pieces of fruit) it is difficult to fill the packing containers in such a manner that the desired proportions of liquid and solid contents are safeguarded. This is the case in particular in modern, fast working packing machines, since the filling time is short and a rapid filling, moreover, increases the risk of contents ending up in undesirable places and rendering difficult the sealing of the packing container. In accordance with the invention which relates to a method as well as to an arrangement for the manufacture of packing containers, this is solved by feeding the solid and liquid parts separately via two filling pipes, the feeding of the liquid contents being ended only after the feeding of solid particles has been ended.

15 Claims, 3 Drawing Figures

METHOD AND AN ARRANGEMENT FOR THE MANUFACTURE OF PACKING CONTAINERS

BACKGROUND AND SUMMARY OF THE INVENTION

The present invention relates to a method for the feeding of contents comprising liquid as well as solid particles in the manufacture of packing containers by repeated transverse flattening and sealing of tubular packing material.

The invention also relates to an arrangement for the realisation of the method, this arrangement comprising devices for the transverse flattening and sealing of a packing material tube extending substantially vertically and filled with contents as well as elements extending into the tube for the feeding of contents as well as packing material tube.

Packing containers for e.g. milk or other liquid foodstuffs are manufactured generally from laminated, flexible material which comprises layers of paper and thermoplastics. A known packing container is formed in that a laminate web, during its advance through the packing machine, is successively converted to tubular shape by the joining together of its two longitudinal edges and sealing them to each other in a liquid-tight manner. The tube so formed is moved substantially vertically downwards through the machine at the same time as the contents are fed continuously via a feeding pipe introduced at the upper, open end of the tube which extends downwards inside the tube. At the lower end of the tube the machine is provided with reciprocating processing jaws co-operating with one another which comprises the passing material tube at equal distances so that transverse flattened zones are produced wherein the walls of the material tube are sealed to one another in a liquid-tight manner. The transverse sealing of the material tube takes place below the contents level and the tube is thus converted to coherent, substantially cushion-shaped packing containers completely filled with contents. After the cushion-shaped packing containers have been separated from one another by cutting through the transverse sealing zones a final shaping process is carried out so that the packing containers obtain the desired, e.g. parallelepipedic, shape.

The packing containers which are manufactured in the manner described above were usable up to now only for those liquid contents which wholly lack, or in any case contain only very small, solid particles, e.g. finely distributed fruit pulp in juice or the like. The reason for this is that any solid particles possibly present in the contents may on flattening of the material tube below the liquid level end up between the material layers which are to be sealed to each other and among other things cause leakages in the transverse seals at the top and bottom of the packing container. If contents in "solid" form (the designation "solid" is used in the description and the claims to designate contents in the form of individual, solid particles, e.g. larger bits of fruit, beans, pieces of asparagus or the like with or without a liquid part) are to be packaged, the feeding of the contents has to take place intermittently and in rhythm with the repeated transverse sealings of the tube so as to prevent the solid particles from disturbing the sealing operation. In other words, the feeding of a portion of contents of the desired volume to each packing container should be started as soon as the first (lower) transverse join of the packing container has been formed and be completed before the flattening and sealing of the second (upper) transverse join of the container of the package. In this manner it can be avoided that the solid particles of the contents get between the material surfaces sealed together in the transverse joins. The method is comparatively slow, however, since a high feed rate may cause the contents to spatter or be thrown about during the filling so that in spite of the feeding of the contents in portions the transverse join cannot be kept free from solid particles. The method also implies that the packing containers are not completely filled, since the risk of inclusions of solid contents in the transverse joins would then be considerably increased.

It is an object of the present invention to provide a method which makes it possible in the continuous manufacture of packing containers from tubular packing material to fill solid particles (bits of fruit etc.) together with liquid contents as well as individually, without the disadvantages experienced hitherto.

It is a further object of the present invention to provide a method of the aforementioned type which while retaining the high machine speeds existing up to now makes it possible to fill solid contents without increasing the risk of leaking packing containers.

These and other objects have been achieved in accordance with the invention in that a method of the type described in the introduction has been given the characteristic that the solid particles are fed to the tube in the form of a metered quantity as soon as a transverse flattening has been completed whereas the liquid is fed during a longer period which is ended only when the feeding of solid particles has been ended.

It is a further object of the present invention to provide an arrangement for the realisation of the above-mentioned method, this arrangement being simple and reliable in operation and designed so that it can be used without major difficulties on known types of packing machines.

It is a further object of the present invention to provide an arrangement which is not subject to the disadvantages of similar arrangements known previously and which is uncomplicated and capable of being washed and sterilised in a simple manner.

It is a further object of the present invention to provide an arrangement which makes it possible to manufacture wholly filled as well as partly filled packing containers.

These and other objects have been achieved in accordance with the invention in that an arrangement of the type described in the introduction has been given the characteristic that the feeding elements comprise a flat pipe for the feeding of liquid and a second pipe for the feeding of solid particles, the second pipe being provided with a valve arrangement.

The method and the arrangement in accordance with the invention present many advantages in that they eliminate the disadvantages of previous constructions and methods and make it possible to make use of known principles of package formation for the manufacture of packing containers which are wholly or partly filled with contents comprising a larger or smaller, accurately metered portion of solid particles. The volume of contents in each individual packing container can be regulated with great accuracy, and fluids with solid particles of diverse kind can be filled. The method and the design of the arrangement eliminate the risk of particles of contents attaching themselves between the material surfaces pressed to each other in transverse joins and thus ensure completely tight transverse seals which make it possible to fill in aseptic as well as non-aseptic manufacture any types of contents which occur in practice in the foodstuffs branch.

BRIEF DESCRIPTION OF THE DRAWINGS

A preferred embodiment of the method as well as of the arrangement in accordance with the invention will now be described in more detail with special reference to the attached schematic drawings which only show the details required for the understanding of the invention.

DETAILED DESCRIPTION OF THE PREFERRED EMBODIMENT

Figure 1:
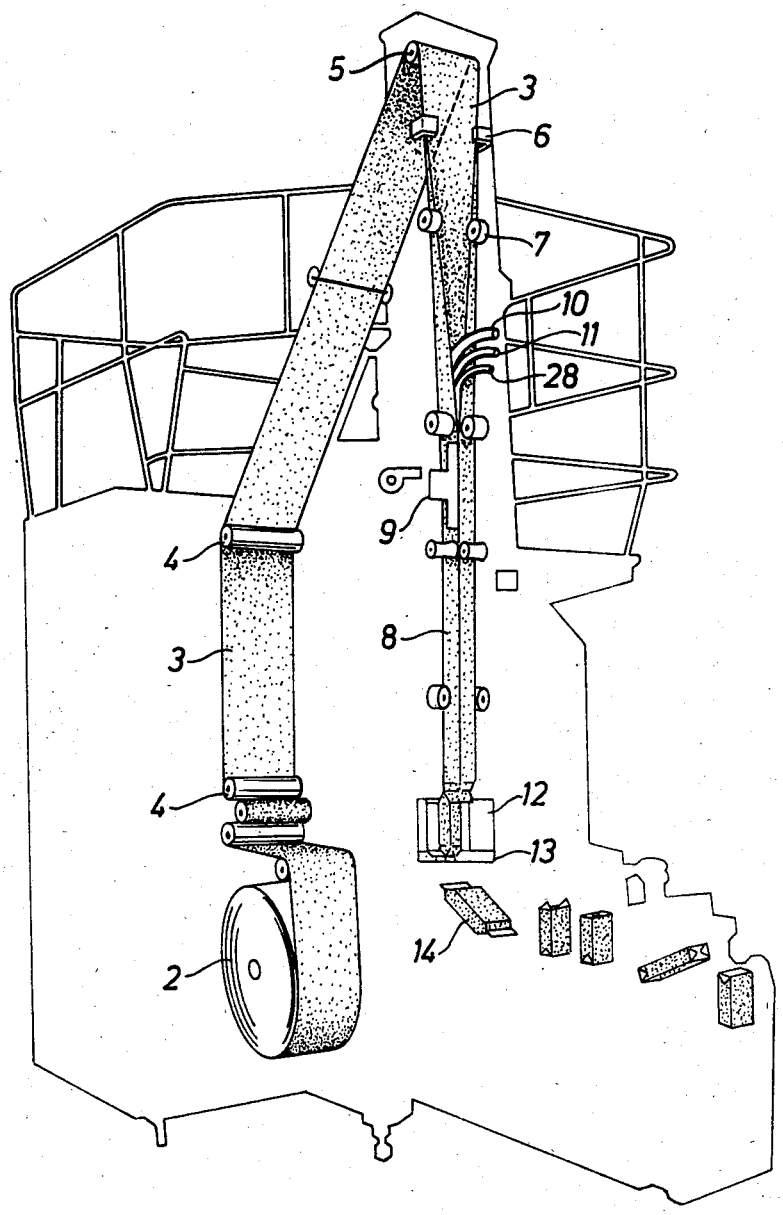
FIG. 1 shows in principle the conversion of a weblike packing material to individual packing containers in a packing machine.

The packing machine indicated in FIG. 1 is of a main type known earlier which converts weblike packing material to individual packing containers. The packing material is a laminate which usually comprises a central carrier layer of paper which is covered on both sides with thin, liquid-tight layers of thermoplastic material, e.g. polythene. The packing laminate is provided with crease lines to facilitate folding and conversion to finished packing containers and is supplied to the packing machine 1 in the form of a roll 2 which is supported so that it can rotate in the magazine of the packing machine. From the magazine the packing material web 3 moves via a number of guide rollers 4 up to the upper part of the machine where it passes over a deflection roller 5, thereafter to continue substantially vertically downwards through the packing machine.

With the help of various folding and forming elements 6, 7 arranged along the path of movement of the material web, the packing material web 3 during its movement downwards through the machine is converted successively to tubular form in that its two longitudinal edges are guided towards each other and sealed together so that a material tube 8 with a longitudinal liquid-tight seal is produced. The sealing together of the two longitudinal edges takes place with the help of a supply of heat by means of a sealing unit 9 of the hot-air type whereby the parts of the thermoplastic layer situated at the edges are made to melt. Thereafter the two longitudinal edges are pressed together with simultaneous cooling which means that the thermoplastic layers are joined to one another so that the desired, wholly liquid-tight joint is obtained.

The contents are then conducted to the lower end of the packing material tube 8 so formed via a feed pipe 10, 11 which extends in through the upper, open end of the packing material tube 8. The feed pipe then runs substantially concentrically downwards through the packing material tube and opens at a little distance above the lower end of the same which will be explained in more detail in the following.

Figure 2:
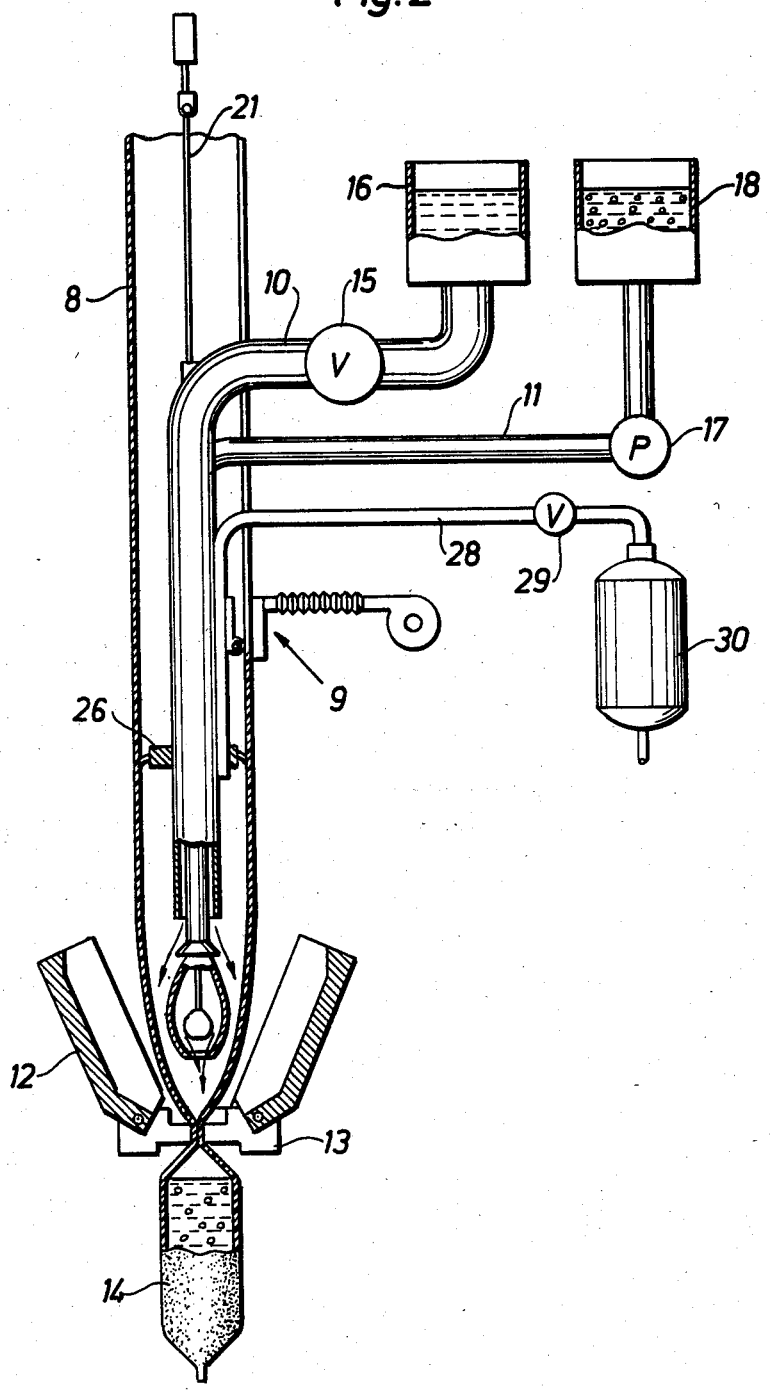
FIG. 2 shows partly in section and on a larger scale the conversion of a packing material tube to individual packing containers in accordance with a preferred embodiment of the method in accordane with the invention.

At some distance below the feed pipe 10, 11 forming and sealing jaws 12, 13 (FIG. 2) are arranged on either side of the packing material tube 8 which are adapted so as to process the packing material tube 8 in pairs between themselves. For the sake of clarity only one set of forming and sealing jaws respectively is shown in the figures, but in practice there are usually a further number of jaws which alternatingly process the packing material tube.

The sealing jaws 13 are moved continuously to and fro in the direction towards and away from each other respectively so as to compress and seal the packing material tube along transverse sealing zones. At the same time the sealing jaws 13 are aoved to and fro in vertical direction so that when they are in the upper end position they. are aoved towards one another and compress and retain the packing material tube. In the subsequent movement downwards through the packing machine the walls of the packing material tube are compressed and welded to each other, the material tube being advanced at the same time over a distance which corresponds to the length of one packing container blank. During the displacement downwards the two forming jaws 12 are swung towards each other so that the part of the packing material tube 8 which is located directly above the sealing jaws 13 is partly compressed and formed to the desired shape, in this case substantially cushion shape with a rectangular cross-section. When the sealing jaws 13 have reached their lower position the forming jaws 12 are swung out again to the position shown in FIG. 2 at the same time as the material tube 8 is severed by a transverse cut through the zone compressed by the sealing jaws. As a result a packing container 14 formed previously will be detached from the packing material tube. After the sealing jaws 13 have been moved away again from each other the packing container 14 is passed with the help of a conveyor (not shown) for continued processing and final shaping so that a packing container of the required shape (in this case parallelepipedic) is produced.

As mentioned earlier, the desired contents are fed to the lower end of the packing material tube 8 via the feed pipe 10, 11. On filling of contents which contain liquid as well as solid particles the feed pipe is divided into two separate ducts or filling pipes 10 and 11 respectively, the liquid freed from particles being fed via one filling pipe 10 whereas the solid contents (preferably mixed with a certain amount of liquid) are fed via the second filling pipe 11. The two filling pipes 10, 11, as mentioned earlier, in the form of the combined feed pipe 10, 11, extend partly through the upper open end of the packing material tube 8, whereafter (see in particular FIG. 2) they run substantially vertically downwards. The vertical parts of the pipes may run parallel alongside one another or be combined, e.g. in that the second pipe extends concentrically inside the first pipe, which not only saves space but also facilitates washing and sterilising, since narrow and not readily accessible spaced and recesses are thereby avoided.

The first filling pipe 10 intended for liquid is connected at its upper end via a valve 15 to a tank or reservoir 16 for the liquid contents. The valve 15 may be designed as a constant flow valve, that is to say a valve which beside its shutoff action is also adjustable for a constant flow of a desired quantity of liquid per unit of time.

The second filling pipe 11, like the first filling pipe 10, extends out of the upper open end of the packing material tube 8 where the second filling pipe is connected to a metering pump 17 and a tank or reservoir 18 for the solid contents which, in order to make possible the filling, are mixed with a certain portion of liquid contents, e.g. of the same type as the contents present in tank 16. The metering pump 17 is constituted preferably of a piston pump which at each stroke delivers a predetermined quantity of contents from the tank to the filling pipe.

Figure 3:
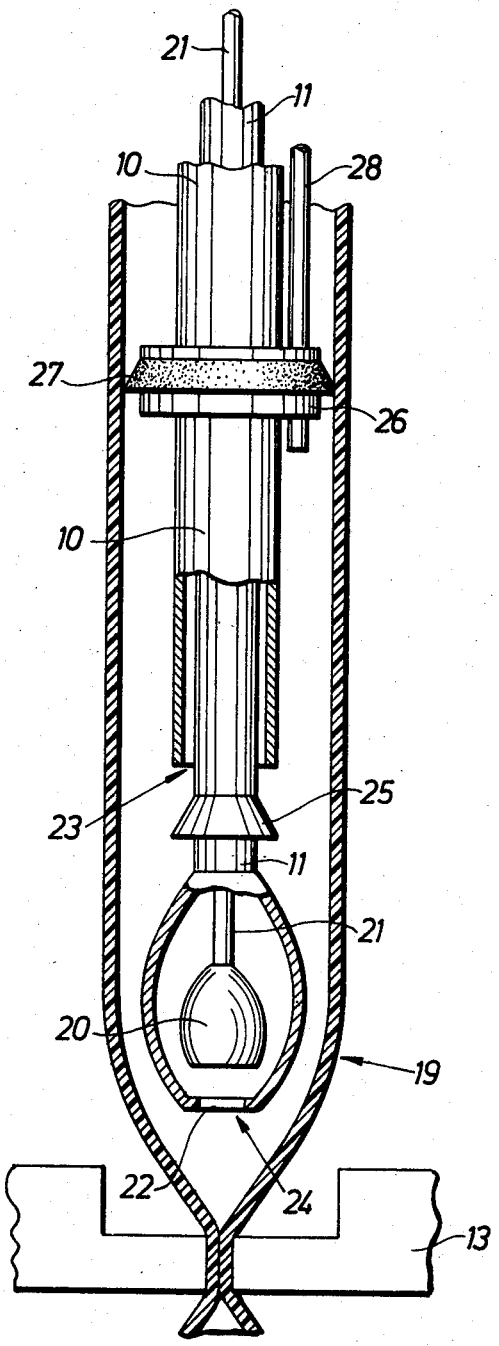
FIG. 3 shows on a larger scale and partly in section the lower part of the packing material tube in accordance with FIG. 2.

At the lower end of the second filling pipe 11 a valve arrangement 19 is present which is best illustrated in FIG. 3, showing the lower end of the material tube and adjoining elements on a slightly larger scale. More particularly, the valve arragnement 19 comprises a valve cone 20 located at the lower end of the second filling pipe 11 which by means of a valve spindle 21 extending concentrically inside the pipe is maneuverable from the outside between the upper open position and a lower shut position, in which it rests against a valve seat 22 formed at the lower end of the pipe 11. To facilitate the flow of contents in the valve cone 20 the cone is designed so that it has an upper bobbin-shaped part and the lower part of the filling pipe 11 is situated has a widened substantially pear-shaped part, at the As mentioned previously, the second filling pipe 11 extends preferably concentrically in the first filling pipe 10. The first filling pipe 10 is a little shorter than the second and the outlet opening 23 of the first filling pipe 10 is situated therefore at a little distance above the outlet opening 24 of the second pipe. Hence the outlet opening 23 of the first pipe 10 will be situated at a little distance above the widened lower part of the filling pipe 11. Between the said widened pipe section and the outlet opening 23 there is a spreader element 25 which is situated directly below the outlet opening 23 and is designed as a collar or bell which, when liquid flows out of the outlet opening, disperses the same outwards in the direction of the inner wall surfaces of the contents tube 8 which will be explained in greater detail in the following. It is possible for the upper part of the widened section of the filling pipe 11 to be so designed and placed in relation to the outlet opening 23 that it serves as a spreader element and thus replaces the separate spreader element 25 shown in FIG. 3.

The filling pipe 10 as well as the filling pipe 11 open into a lower part of the packing material tube 8 at some distance above the place where during operation the forming and sealing jaws 12, 13 process and press together the material tube.

This lower part of the tube is delimited from the upper open part of the tube with the help of a sealing device 26 which comprises a circular sealing lip 27 of flexible material, e.g. rubber or plastics, resting against the inner surface of the material tube. The sealing device 26 is carried by the first filling pipe 10 and thus adjoins the outer surface of the same in a sealing manner. A third pipe 28 also extends through the sealing device 26 for the feed of gaseous medium to the lower end of the material tube closed by means of the sealing device 26. The pipe 28, like the two other filling pipes 10, 11, extends out through the open, upper end of the tube where the pipe is connected via a valve 29 to a pressure tank 30 which contains sterile air at a predetermined pressure. The tank 30 is connected to a compressed air supply, not shown.

When the packing machine with the arrangement in accordance with the invention is in operation, the packing material web is advanced from the roll 2 via a number of deflection and guide rollers 4, 5 to the upper part of the packing machine, whereafter it is moved substantially vertically downwards through the machine. During the movement of the material web 3 downwards through the machine a successive conversion of the material web to tubular shape is taking place in that its two longitudinal edges are acted upon in direction towards each other by folding and forming elements 6, 7 arranged in the path of movement of the material web. When the material web 3 has been folded to such an extent that the two longitudinal edges overlap one another, they pass the sealing unit 9 wherein the thin thermoplastic outer layers of the material web are subjected to a current of hot air which heats the thermoplastics to melting temperature. Then the two edges are pressed against each other whilst being cooled so that the thermoplastic layers are caused to fuse together and a packing material tube with a liquid-tight longitudinal joint is obtained. During its continued movement downwards through the machine the packing material tube is filled with contents via the feed pipe 10, 11, whereafter the material tube is converted with the help of forming and sealing jaws 12, 13 through repeated transverse flattening and forming to substantially cushion-shaped packing container blanks. At the same time as the sealing jaws 13 flatten the packing material tube between themselves, heat is supplied so that the thermoplastic layers situated on the inner surfaces of the packing material tube melt and are sealed to one another. As a result a liquid-tight seal is produced which either has a relatively large width or is divided into parallel sealing areas between which the material tube is then cut so that the packing container formed can be detached from the material tube. At the same time the material tube acquires a liquid-tight seal at its bottom end and the process can be repeated for the manufacture of further packing containers.

When the packing material web 3 has passed the sealing unit 9 and thus has been converted to the liquid-tight packing material tube 8, it passes the sealing device 26 whose sealing lip 27 rests in a fexible manner against the inner surface of the packing material tube. As a result of this a lower separate chamber is formed into which open both filling pipes 10, 11 as well as the feed pipe 28 for sterile air. The said chamber is pressurised via the feed pipe with sterile air of the desired pressure which is fed continuously in rhythm with the consumption of air caused by the fact that each finished package comprises a certain quantity of air so as to form a so-called headspace. In the course of the continuous feeding of air under pressure via the feed pipe 28 a certain pressure in the lower closed end of the packing material tube is maintained. This pressure is required to make possible the shaping of the tube and prevent the material tube from being wrinkled together in an unchecked manner when the shaping jaws 12 compress it so as to impart to the same a substantially square cross-section.

The two cooperating sealing jaws 13, as mentioned previously, on the one hand move towards and away from each other to make possible the repeated, transverse flattening of the packing material tube, on the other hand move vertically upwards and downwards in working and return strokes to advance the packing material tube and detach suitable lengths of the same for the manufacture of individual packing containers. The feed of contents takes place in rhythm with the movements of the sealing jaws and, more particularly, the solid particles are fed in the form of a metered quantity as soon as the sealing jaws have completed a transverse flattening and the packing material tube consequently is sealed off from the newly formed packing container. The liquid contents are fed during a longer period which is ended only when the feed of solid particles has been ended. To avoid any jamming of solid particles between the material layers pressed together by the sealing jaws it is of great importance that the part of contents which contains solid particles is not fed in such a way that it reaches the lower end of the tube before the pressing together of the tube walls with the help of the sealing jaws 13 has been completed. The sealing work itself, that is to say the heating and sealing together of the layers of thermoplastic material in the transverse, flattened region of the tube, however, does not have to be completed or even have been started when the solid particles reach the lower end of the tube, since the pressing together by itself ensures that the lower end of the tube has sufficient tightness to prevent any particles from reaching the actual sealing region. Consequently the feeding of solid particles may commence as early as possible during the working cycle, which is of considerable importance for the working rate of the machine, since the time available for the filling of each packing container is very limited.

The feed of the solid contents is facilitated, as mentioned previously, in that the particles of contents are mixed up with liquid, and the mixture is pumped with the help of the metering pump 17 via the second filling pipe 11 to the lower end of the packing material tube. The metering pump 17 is preferably of the piston type and is synchronised with the movement of the sealing jaws 13 so that the feeding of the desired quantity takes place at the correct juncture in accordance with the above reasoning. The valve arrangement 19 situated at the lower end of the second filling pipe too is maneuvered in rhythm with the movement of the sealing jaws 13 and ensures that the lower end of the filling pipe 11 is open only during the correct period in relation to the movement of the jaws and the working stroke of the pump 17. The valve 19 is shut preferably only after the pump 17 has commenced its return stroke so that during a limited period a certain return suction in the filling pipe 11 is created. This helps to ensure that no afterdripping in any form from the filling pipe takes place which is of great importance since otherwise the surfaces, which afterwards are to be pressed together for the formation of transverse sealing zones, may be contaminated by solid particles of the contents.

To eliminate further the risk of contaminations by solid particles on the surfaces which are to be sealed, use is aade of the liquid contents which are fed via the first filling pipe 10 in order to flush clean the wall surfaces of the packing material tube. More particularly, the liquid contents, as they flow out through the outlet opening 23 at the lower end of the first filling pipe 10, are directed in such a way with the help of the spreader element 25 that they flow along the inner wall surface of the tube. The feed of the liquid contents may be continuous and occur at a uniform speed which is regulated with the help of the constant flow valve 15. Through correct adaptation of the outflowing quantity of liquid per unit of time the feed of the liquid contents portions to each individual package can be controlled simply through movement of the sealing jaws 13. The feed of liquid to each individual package will thus be limited simply in that the jaws 13 flatten the material tube and so interrupt the inflow to the actual package. If desired it is also possible, of course, to introduce a shut-off valve controlled in rhythm with the sealing jaws 13 into the filling pipe 10 so that the feed of liquid can be interrupted already before the transverse flattening of the packing material tube 8 has been completed. This method can be particularly appropriate in the filling of partially filled packing containers with contents whose solid particles are relatively small and mobile, since any risk of the inflowing liquid contents "swirling up" the solid particles to the region intended for the upper transverse sealing is thereby eliminated. However, the flow of liquid contents along the inner wall surface of the material tube has proved in practice to provide good safety that particles from the inside of the material tube will not be present on the surface when the flattening takes place, even if contents particles were to contaminate the surface of the packing material in spite of the feeding being central and synchronised with the jaw movements.

By the arrangement and method in accordance with the invention it has been found possible in practical experiments to fill a packing container with contents in the desired quantity and the desired ratio between the solid and liquid parts with great accuracy. While the filling can take place at an unexpectedly high speed, the risk of inclusion of particles of goods in the transverse seals has been eliminated so that the packing containers produced show good tightness.

What is claimed is:

1. A method for the feeding of liquid contents and solid particles during the manufacture of packing containers by repeated transverse flattening and sealing of packing material in the form of a tube, comprising, transversly flattening and sealing said packing material, feeding the solid particles to the tube in the form of a metered quantity after said transverse flattening of the packing material has been completed, feeding the liquid during a period longer than feeding of the solid particles, said longer feeding period being ended only when the feeding of solid particles has been ended, flushing wall surfaces of the tube with the liquid, and subsequently transversely flattening and sealing said packing material to form a packing container having said liquid and solid particles therein.

2. A method in accordance with claim 1, further including ending the feeding of liquid before the subsequent, transverse flattening has been completed.

3. A method in accordance with claim 1, further including interrupting the feeding of liquid to a packing container by the subsequent transverse flattening.

4. A method in accordance with claim 1, further including continuously feeding the liquid to the material tube at a constant flow.

5. A method in accordance with claim 1, including feeding the solid particles centrally into the tube whereas the liquid is made to flow along the wall of the tube.

6. A method in accordance with claim 1, wherein the solid particles are fed in a condition partly mixed with liquid.

7. An arrangement for the feeding of liquid contents and solid particles during the manufacture of packing containers including devices for transverse flattening and sealing of a packing material tube extending substantially vertically and being filled with contents, as well as elements extending into the tube for the feeding of contents to the packing material tube, comprising, a first pipe for the feeding of liquid and a second pipe for the feeding of solid particles, the first and second pipes defining the feeding elements, a spreader element positioned at an opening end of the first pipe, the second pipe being provided with a valve arrangement including a valve cone located at a lower end of the second pipe and maneuverable between an open and a shut position, in the shut position the valve cone rests against a valve seat formed at the lower end of the pipe and the first pipe arranged to provide for delivery of the liquid along wall surfaces of the tube so as to flush solid particles therefrom.

8. An arrangement in accordance with claim 7, wherein the second pipe extends concentrically inside the first pipe.

9. An arrangement in accordance with claim 7, wherein an outlet opening of the first pipe is situated above an outlet opening of the second pipe.

10. An arrangement in accordance with claim 7, wherein the valve cone is located inside the second pipe and is formed with a substantially bobbin-shaped upper part.

11. An arrangement in accordance with claim 7, wherein the valve cone is manoeuvrable by means of a valve spindle extending concentrically inside the second pipe.

12. An arrangement in accordance with claim 7, wherein a third pipe for feeding of a gaseous medium extends inside the tube.

13. An arrangement in accordance with claim 7, wherein all the pipes open in a lower part of the tube which is delimited from an upper, open part of the tube as well as from the surrounding air by means of a sealing device.

14. An arrangement in accordance with claim 7, wherein the second pipe at an upper, open end of the tube is connected to a metering pump.

15. An arrangement in accordance with claim 7, wherein the first pipe at an upper part extending through the material tube is connected via a constant flow valve to a reservoir for the liquid contents.

* * * * *